United States Patent [19]

Reynolds

[11] Patent Number: 4,913,030

[45] Date of Patent: Apr. 3, 1990

[54] ELECTROMAGNETIC GUN

[75] Inventor: Graham A. Reynolds, Coventry, England

[73] Assignee: Rolls-Royce plc, London, England

[21] Appl. No.: 18,484

[22] Filed: Feb. 20, 1987

[30] Foreign Application Priority Data

Mar. 14, 1986 [GB] United Kingdom ..... 8606394

[51] Int. Cl.[4] ..... F41F 1/02

[52] U.S. Cl. ..... 89/8; 124/3; 318/135

[58] Field of Search ..... 89/8; 124/3; 316/10, 316/11, 12, 13, 14; 318/35, 135

[56] References Cited

U.S. PATENT DOCUMENTS 4,319,168 3/1982 Kemeny ..... 89/8
4,651,024 3/1987 Hickey ..... 89/8
4,718,322 1/1988 Honig et al. ..... 89/8

FOREIGN PATENT DOCUMENTS 2123934 2/1984 United Kingdom ..... 89/8
2141215 12/1984 United Kingdom ..... 89/8

OTHER PUBLICATIONS

Ruby et al., "Electromagnetic Launchers", Popular Science, Nov. 1981, pp. 79–81.

*Primary Examiner*—Stephen C. Bentley
*Attorney, Agent, or Firm*—Cushman, Darby & Cushman

[57] ABSTRACT

An electromagnetic gun comprises a barrel for containing and directing an electrically conductive projectile and a plurality of inductors which are arranged in series relationship along the barrel so as to create magnetic fields which accelerate the projectile along the barrel. Each inductor is associated with a pair of rail electrodes within the barrel bore which, when bridged by the projectile, short circuit their associated inductor to provide additional acceleration of the projectile.

14 Claims, 4 Drawing Sheets

10
11
12
13
14
15
16
17
18
19
20
21
22
23
24
25
26

14
15
19
20
21
24
25
26
+VE
-VE 25a
11a
33
17a
16a
15a
34
24a
14a
13a
12a
20a
19a
22a
21a
23a 25a
15a
14a
21a
+VE
20a
19a
-VE
21a

ELECTROMAGNETIC GUN

This invention relates to electromagnetic guns and projectiles therefor.

It is known to provide a device called a charged particle accelerator which comprises two parallel rail electrodes having an electrically conductive substance situated in the gap between them. When a very large electric current is passed between the electrodes via the electrically conductive substance, intense electric and magnetic fields are established. This results in the acceleration of the electrically conductive substance along the gap between the rail electrodes by the force resulting from the interaction between the magnetic field between the rail electrodes and the moving change particles in the conductive substance. Any conducting substance may be accelerated in this manner. For instance it is well known to form a current conducting plasma between two rail electrodes by discharging a storage capacitor to explosively vapourise an electrical conductor located between the rail electrodes. The normal configuration of a plasma accelerator is such that a magnetic field is established behind the plasma that is perpendicular to the current passing through the plasma. The resultant mutually perpendicular force on the plasma accelerates it along the gap between the rail electrodes.

Charged particle accelerators or rail guns as they are sometimes known as, can be used as effective weapon systems. The electrically conductive substance situated between the rail electrodes can be in the form of a projectile. If an electrical current of sufficient magnitude is passed through the rail electrodes and projectile, very high levels of projectile acceleration can be achieved. In an alternative form of charged particle accelerator, a non-conducting substance such as a ceramic may be used as a projectile. The acceleration of such a non-conducting projectile is achieved by the creation of a plasma behind the projectile so that acceleration the plasma causes resultant acceleration of the projectile.

The drawbacks of such systems are that they tend to be effective only in the rapid acceleration of small projectiles and that problems are frequently encountered with the interaction between the projectile or plasma and the rail electrodes. Thus in the case of solid electrically conductive projectiles, an effective system of electrical contact has to be established between the projectile and rail electrodes and in the case of a plasma, a great deal of electrode damage can occur over the lengths of the electrodes as a result of their attack by the hot plasma.

If it is desired to accelerate projectiles which are larger than those which can be effectively accelerated by a charged particle accelerator and avoid the problem of rail electrode projectile interaction, use may be made of a linear induction accelerator. A suitable linear induction accelerator may comprise a tube or barrel to contain and direct the projectile to be accelerated, and a plurality of inductors in the form of coils which are arranged in series relationship along the barrel. If the inductors are sequentially activated by the passage of a large current therethrough, a series of magnetic fields are created which act upon the projectile to accelerate it along the barrel.

Thus since a current is not required to flow from the barrel to the projectile, physical contact between them is not necessary, thereby avoiding electrode/projectile interaction problems. However although a linear induction accelerator is capable of accelerating larger projectiles than a charged particle accelerator, it is not as efficient. More specifically when the current supplied to the inductors ceases, the magnetic fields which they had created collapse and induce an e.m.f. in the inductors, thereby resulting in a loss of energy.

It is an object of the present invention to provide an electromagnetic gun which is capable of accelerating projectiles which are of greater mass than those which can be effectively and conveniently accelerated by a charged particle accelerator and which is more efficient than a linear induction accelerator.

According to the present invention, an electromagnetic gun comprises a barrel for operationally containing and directing an electrically conductive projectile, at least one inductor so configured and arranged that when electrically activated it creates a magnetic field within said barrel which is so orientated as to accelerate along said barrel any said projectile operationally located therein, and at least one pair of parallel rail electrodes positioned downstream, with respect to projectile motion, of at least the majority of the magnetic field created by said activated inductor, and additionally aligned with the direction of projectile motion, said rail electrodes being electrically connected in parallel with said inductor and so positioned within said barrel as to be electrically interconnected by any said projectile upon the passage thereof between said electrodes to short circuit said inductor.

The invention will now be described, by way of example, with reference to the accompanying drawings in which.

Figure 1:
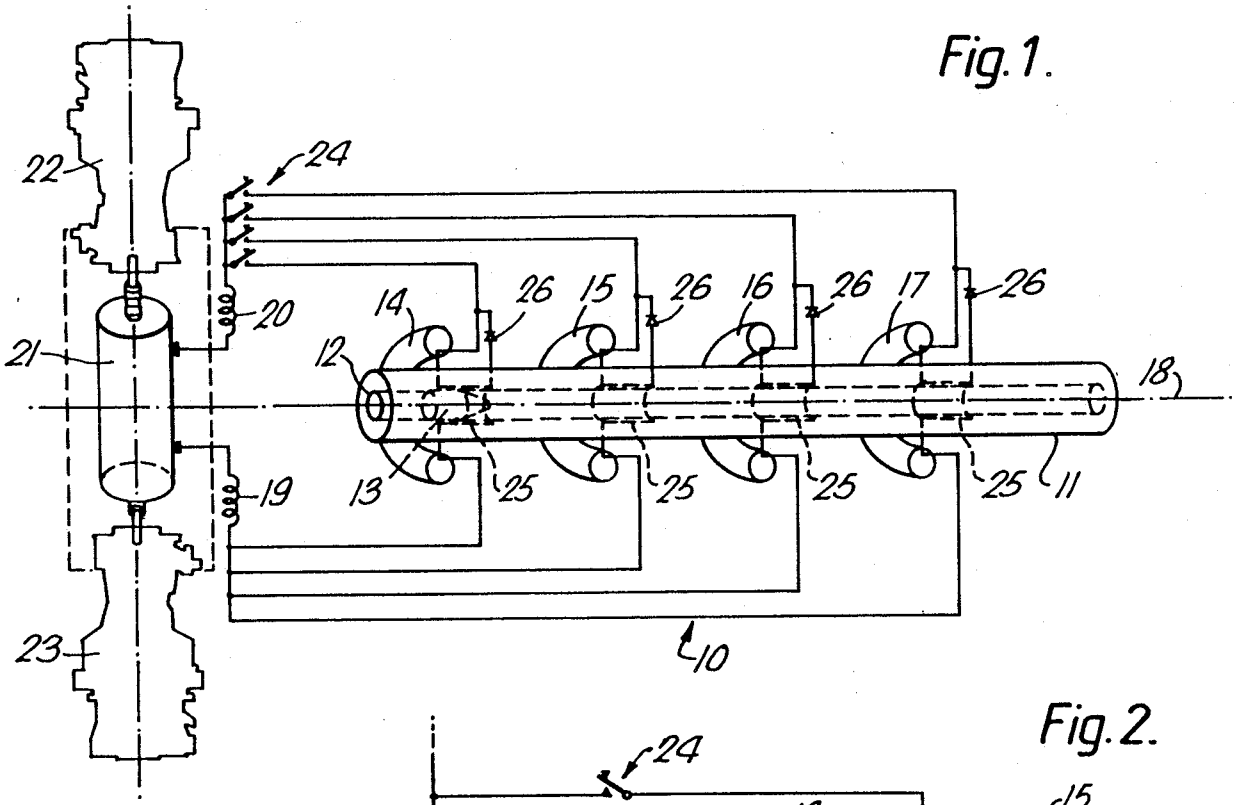
FIG. 1 is a schematic depiction of one form of electromagnetic gun in accordance with the present invention together with its associated power unit.

With reference to FIG. 1, an electromagnetic gun generally indicated at 10 comprises a barrel 11 having an octagonal cross-section bore 12 which in operation contains a projectile 13 the majority of which is of corresponding cross-sectional shape. The barrel 11 is surrounded by four similar inductors 14,15,16 and 17 although it will be understood that a greater or lesser number of inductors could be employed if so desired. Each of the inductors 14,15,16 and 17 is in the form of an annular coil which is so positioned with respect to the barrel 11 as to be coaxial with the barrel axis 18. The inductors 14,15,16 and 17 are all electrically connected in parallel via additional inductors 19 and 20 with the output of a homopolar generator 21. The homopolar generator 21 is of conventional construction and is driven by two similar gas turbine engines 22 and 23 which are also of conventional construction. The homopolar generator 21 is so arranged as to provide a very large electrical output of short duration.

The inductors 14,15,16 and 17 are thus arranged that when electrically activated by the large electrical output of the homopolar generator, they each create a magnetic field which tends to accelerate the projectile 13 along the barrel 11. In order to achieve progressive acceleration of the projectile 13, the inductors 14,15,16 and 17 are sequentially activated by a series of switches 24. Thus the first inductor 14 is activated to accelerate the projectile 13 along the barrel 11 until it reaches the second inductor 15 whereupon the second inductor 15 is activated to accelerate the projectile 13 along the barrel to the third inductor 16 and so on. A linear induction accelerator is thereby defined by the inductors 14,15,16 and 17.

The drawback of an electromagnetic gun relying solely on the magnetic fields created by the inductors 14,15,16 and 17 to accelerate the projectile 13 is that the energy stored in the inductors 14,15,16 and 17 is lost when the current to the inductors 14,15,16 and 17 is discontinued. This energy may be expressed as $\frac{1}{2}I^2L$ where I=current flowing through the inductance and L=the inductance of the inductor.

The present invention seeks to make use of this lost energy to provide additional acceleration of the projectile 13. This is achieved by the provision of rail electrodes within the barrel 11 which are electrically connected in parallel with the inductors 14,15,16 and 17. More specifically each inductor 14,15,16 and 17 has one pair of parallel rail electrodes 25 connected in parallel therewith as can be seen more clearly in FIG. 2. Each pair or rail electrodes 25 is located within the bore 12 of the barrel 11 so that it is immediately downstream, with respect to projectile 13 motion, of its associated inductor 14,15,16 and 17 respectively. Additionally each rail electrode pair 25 is aligned with barrel bore 12 and so positioned as to make electrical contact with the projectile 13 as it passes between the electrodes.

After the projectile 13 has been accelerated along the barrel 11 by the magnetic field created by inductor 14, it passes between the rail electrodes 25 electrically connected to the inductor 14. A portion of the projectile 13 is electrically conductive so that as soon as the rail electrodes 25 are electrically interconnected by the projectile 13, they serve to short circuit the inductor 14. A suitable diode 26 prevents short circuiting of the homopolar generator 21. Thus the energy within the inductor 14, instead of being lost, is directed to the rail electrodes 25 where it serves to create a field which provides additional acceleration of the projectile 13. The rail electrodes 25 thus each constitute a charged particle accelerator. After this double acceleration, the projectile 13 travels to the second inductor 15 and its associated rail electrodes 25 where the same mechanism of double acceleration takes place and the mechanism is repeated with the remaining inductors 16 and 17 and their associated rail electrodes 25 so that they all cooperate to provide rapid acceleration of the projectile 13.

Figure 5:
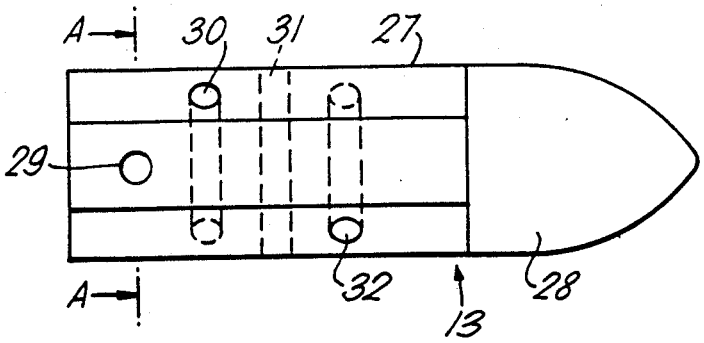
FIG. 5 is a side view of a projectile suitable for use with an electromagnetic gun in accordance with the present invention showing its disposition with respect to a portion of that electromagnetic gun.
Figure 6:
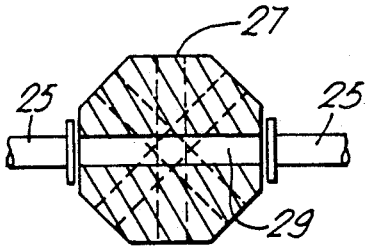
FIG. 6 is a view on section line A—A of FIG. 5.

The construction of the projectile 13 can be seen more clearly if reference is made to FIGS. 5 and 6. The projectile 13 is in fact made up of two portions: an octagonal cross-section sabot 27 and a head 28, although it will be understood that the sabot 27 and head 28 could be integral if so desired.

The sabot 27 is formed from a non-electrically conductive material, such as a ceramic, as is the head 28. Four passages 29,30,31 and 32 extend transversely through the sabot 27 to interconnect its opposite faces so that the passages are angularly disposed with respect to each other. The passages contain a suitable metallic material.

The rail electrode pair 25 associated with the first inductor 14 are aligned with the passage 29 at the rearward end of the sabot 27 as can be seen in FIG. 6. As the projectile 13 is accelerated by the magnetic field of the inductor 14, the rail electrodes 25 come into close proximity with the metallic material within the passage 29. The large potential difference across the rail electrodes 25 causes vaporization of the metallic material so that an electrically conductive plasma is created within the passage 29. It is this plasma which is accelerated by the resultant field and in turn the plasma accelerate the sabot 27 and its head 28.

When the sabot 27 travels beyond the influence of the rail electrodes 25 associated with the first inductor 14, the plasma within the passage 29 is destroyed. However the rail electrodes 25 associated with the second inductor 15 are positioned so as to be aligned with second sabot passage 30 and a second plasma is created. That second plasma is then further accelerated to provide additional acceleration of the sabot 27 and its head 28. The rail electrodes 25 associated with the remaining inductors 16 and 17 are similarly aligned with the ends of the sabot passages 31 and 32 so that still further plasmas are created to facilitate greater sabot 27 acceleration.

Figure 2:
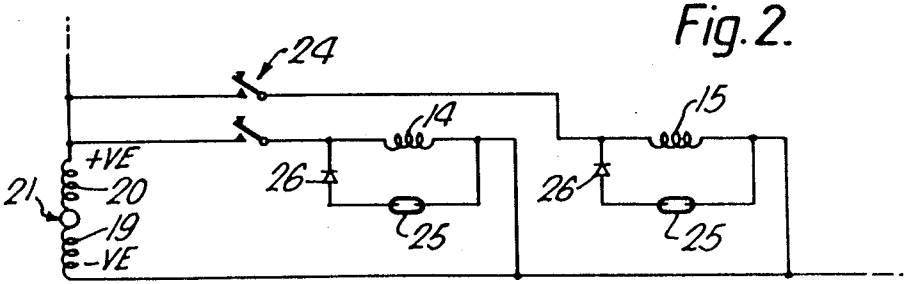
FIG. 2 is a circuit diagram of a portion of the electrical circuit of the electromagnetic gun shown in FIG. 1.
Figure 3:
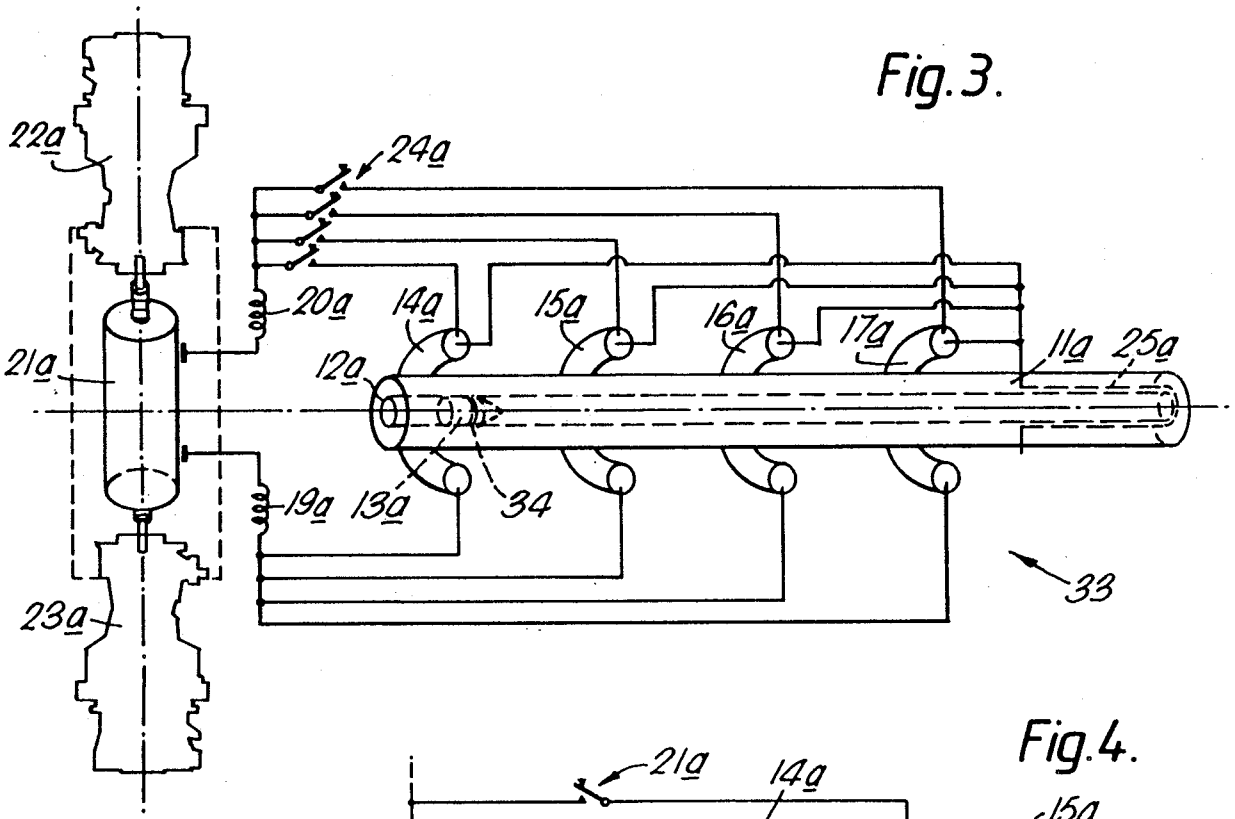
FIG. 3 is a schematic depiction of an alternative form of electromagnetic gun in accordance with the present invention together with its associated power unit.
Figure 4:
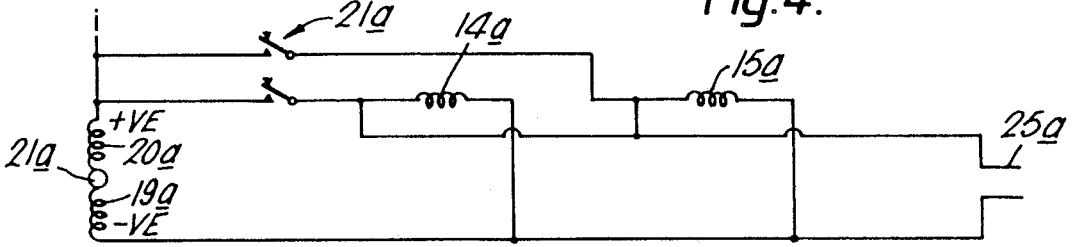
FIG. 4 is a circuit diagram of a portion of the electrical circuit of the electromagnetic gun shown in FIG. 3.

In an alternative embodiment of the present invention depicted in FIGS. 3 and 4, components common with the electromagnetic gun 10 described with respect to FIG. 1 and 2 are given like numerals suffixed with the letter *a*. The essential difference between the electromagnetic gun 33 shown in FIGS. 3 and 4 and that 10 shown in FIG. 1 and 2 is in the disposition of the rail electrodes 25*a*. Thus instead of having a series of rail electrodes 25 as is the case with the electromagnetic gun 10, the electromagnetic gun 33 is provided with only one pair of rail electrode 25*a*. The rail electrodes 25*a* are located within the barrel bore 12*a* so as to make electrical contact with the projectile 13*a* as it passes between them in a similar manner to the rail electrodes 25. However the rail electrodes 25*a* are located downstream, with respect to projectile 13*a* motion through the barrel 11*a*, of the last inductor 17*a*.

In operation, the inductors 14*a*, 15*a*, 16*a* and 17*a* are sequentially electrically activated to accelerate the projectile along the barrel in a similar manner to the electromagnetic gun 10. However the rail electrodes 25*a* are, as can be seen from the circuit diagram of FIG. 4, electrically interconnected in parallel with all of the inductors 14*a*, 15*a*, 16*a* and 17*a*. Thus when the projectile has been accelerated by the inductors 14*a*, 15*a*, 16*a* and 17*a* it passes between the rail electrodes 21*a* and thereby short circuits all of the inductors 14*a*, 15*a*, 16*a* and 17*a* simultaneously. The energy stored in those inductors serves to provide addition acceleration forces for the projectile in the manner described earlier with respect to the rail electrodes 21 of the electromagnetic gun 10.

Since the projectile 13*a* has only to make electrical contact with one pair of rail electrodes 21*a*, there is no need to provide a series of plasma sources as is the case with the projectile 13. Thus the projectile 13*a* need only be provided with a ring 34 of electrically conductive material around its circumference to provide the necessary electrical interconnection between the rail electrodes 21*a* the remainder of the projectile being formed from ceramic material. It will be appreciated however that some suitable device such as a brush arrangement, may be necessary on the rail electrodes 21*a* to facilitate effective electrical contact with the projectile 13*a*. It also follows that the barrel bore 12*a* and the projectile 13*a* need not be of octagonal cross-sectional shape and may conveniently be of circular cross-sectional shape.

Figure 7:
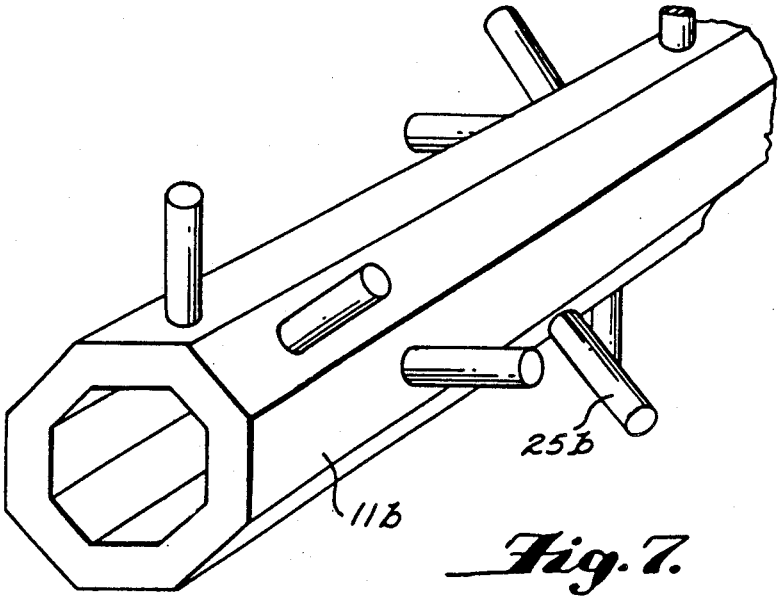
FIGS. 7 and 8 are perspective and end views in elevation, respectively, of another embodiment of the electromagnetic gun of the present invention.
Figure 8:
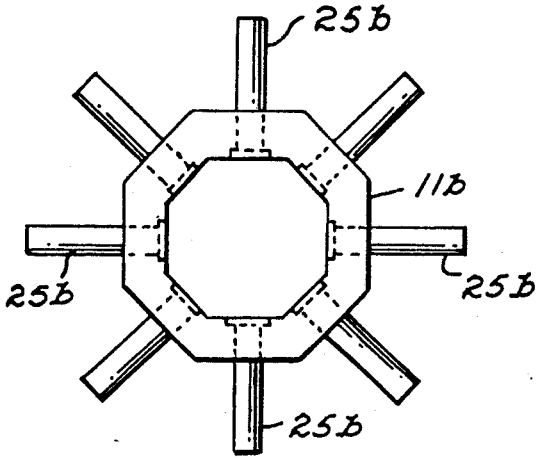

With reference now to FIGS. 7 and 8, another embodiment of the electromagnetic gun of the present invention is illustrated and is provided with a barrel 11b of octagonal cross-section where the rail electrodes 25*b* are distributed along the barrel in a helical path.

It will be seen therefore that electromagnetic guns in accordance with the present invention enjoy the advantages of known charged particle accelerators and linear induction accelerators whilst avoiding at least some of their disadvantages.

Although the present invention has been described with reference to electromagnetic guns which utilise gas turbine engines and homopolar generators as power sources, it will be appreciated that other high energy power sources, such as nuclear reactors, magnetohydrodynamic generators and magnetic flux compression generators could be utilised if so desired. However gas turbine engines and homopolar generators have the virtues of compact size and portability which makes their use attractive in, for instance, tank mounted electromagnetic guns.

I claim:

1. An electromagnetic gun comprising a barrel for containing and directing an electrically conductive projectile, at least one inductor means disposed adjacent to said barrel so that, when said inductor means is electrically actuated by connection to a power source, a magnetic field will be created within said barrel and so oriented so as to accelerate along a path including said barrel a said projectile located therein, at least one pair of parallel rail electrodes positioned along said path and downstream of at least a major portion of the magnetic field created by actuation of said inductor means, said rail electrodes being electrically connected in parallel with said inductor means and being positioned within said barrel and relative to said path of said projectile so that, upon passage of a said projectile, said rail electrodes will be electrically interconnected with said projectile to short circuit said inductor means.

2. An electromagnetic gun as claimed in claim 1 wherein said inductor means comprises a plurality of inductors with each said inductor having a rail electrode pair associated therewith in series relationship along said barrel, each of said rail electrodes being electrically interconnected in parallel with and positioned downstream of its associated inductor so that said inductors and rail electrode pairs are alternately located along said barrel, means being provided for sequential electrical activation of said inductors.

3. An electromagnetic gun as claimed in claim 1 wherein means are provided to prevent the short circuiting of the power source for said electrical activation upon the short circuiting of said at least one inductor.

4. An electromagnetic gun as claimed in claim 3 wherein said means to prevent the short circuiting of said power source comprises diode means.

5. A projectile for use in an electromagnetic gun as claimed in claim 1 wherein said projectile includes a source of material capable of forming a plasma upon cooperation with said at least one pair of said rail electrodes when electrically activated.

6. A projectile as claimed in claim 5 wherein said projectile comprises a sabot, said plasma forming material being located within said sabot.

7. A projectile as claimed in claim 6 wherein said sabot is formed from a ceramic material.

8. An electromagnetic gun as claimed in claim 1 wherein said gun is provided with a plurality of said inductors in series relationship along said barrel and one pair of said rail electrodes electrically interconnected in parallel with all of said inductors, said pair of rail electrodes being positioned downstream, with respect to said projectile motion, of all of said inductors.

9. An electromagnetic gun as claimed in claim 1 wherein the source of power for the electrical activation of said inductors comprises a homopolar generator.

10. An electromagnetic gun as claimed in claim 9 wherein said homopolar generator is powered by at least one gas turbine engine.

11. An electromagnetic gun comprising a barrel for containing and directing an electrically conductive projectile, at least one inductor means disposed adjacent to said barrel so that, when said inductor means is electrically actuated by connection to a power source, a magnetic field will be created within said barrel and so oriented so as to accelerate along a path including said barrel a said projectile located therein, at least one pair of parallel rail electrodes positioned along said path and downstream of at least a major portion of the magnetic field created by actuation of said inductor means, said rail electrodes being connected in parallel with said inductor means and being positioned within said barrel and relative to said path of said projectile so that, upon passage of a said projectile, said rail electrodes will be electrically interconnected with said projectile to short circuit said inductor means, said inductor means comprising a plurality of inductors with each inductor having a rail electrode pair associated therewith in series relationship along said barrel, said inductors and rail electrode pairs being alternately located along said barrel, means being provided for the sequential electrical activation of said inductors, each of said rail electrode pairs being out of axial alignment, with respect to said barrel, with its adjacent rail electrode pair.

12. An electromagnetic gun as claimed in claim 11 wherein the cross-sectional shape of the bore of said barrel is in the form of a regular polygon having an even number of sides, each of the electrodes of each of said rail electrode pairs being located on opposite parallel faces of said bore.

13. A projectile for use in an electromagnetic gun as claimed in claim 11 wherein said projectile includes a plurality of sources of material capable of forming a plasma upon cooperation with said pairs of rail electrodes, said sources of material being disposed transversely with respect to projectile motion and angularly disposed with respect to each other so that each source of material is aligned with a different pair of said rail electrodes.

14. A projectile for use with an electromagnetic gun as claimed in claim 12 wherein at least a portion of said projectile is of the same cross-sectional shape as the bore of said barrel and said projectile includes a plurality of sources of material capable of forming a plasma upon cooperation with said pairs of rail electrodes, said sources of material being disposed transversely with respect to projectile motion and angularly disposed with respect to each other so that each source of material is aligned with different pairs of said rail electrodes.

* * * * *